United States Patent [19]

Bliss

[11] 4,241,832

[45] Dec. 30, 1980

[54] CUSHIONING FOR CONTAINER

[76] Inventor: Russell F. Bliss, 347-104th La. NE., Blaine, Minn. 55434

[21] Appl. No.: 72,563

[22] Filed: Sep. 4, 1979

[51] Int. Cl.[3] ..... B65D 81/02; B65D 85/30

[52] U.S. Cl. ..... 206/523; 206/585

[58] Field of Search ..... 206/523, 524, 585, 586, 206/587

[56] References Cited

U.S. PATENT DOCUMENTS

| | | | |
|---|---|---|---|
| 2,319,966 | 5/1943 | Wood et al. | 206/587 |
| 2,863,595 | 12/1958 | Emery | 206/587 |
| 3,306,967 | 2/1967 | Turkewitsch | 206/523 X |
| 3,314,584 | 4/1967 | Knapp et al. | 206/523 |
| 3,334,798 | 8/1967 | Pezely, Jr. et al. | 206/523 |
| 3,559,866 | 2/1971 | Olson, Sr. | 206/587 |
| 3,580,469 | 5/1971 | Reese | 206/523 X |
| 3,955,744 | 5/1976 | Casutt | 206/587 X |
| 4,120,441 | 10/1978 | Hurley | 206/586 |

FOREIGN PATENT DOCUMENTS

| | | | |
|---|---|---|---|
| 1548810 | 10/1968 | France | 206/523 |

*Primary Examiner*—Joseph Man-Fu Moy

*Attorney, Agent, or Firm*—H. Dale Palmatier

[57] ABSTRACT

A wave-shaped strip of expanded polyethylene having planar surfaces at the wave peaks, such that the strip can be positioned on either side or on the planar surfaces within a container, to provide cushioning for loads placed in the container. An adhesive layer can be applied to the sides and to the planar surfaces, for firmly securing the strip, or a plurality of strips, within the container in any desired configuration.

11 Claims, 19 Drawing Figures

FIG. 1
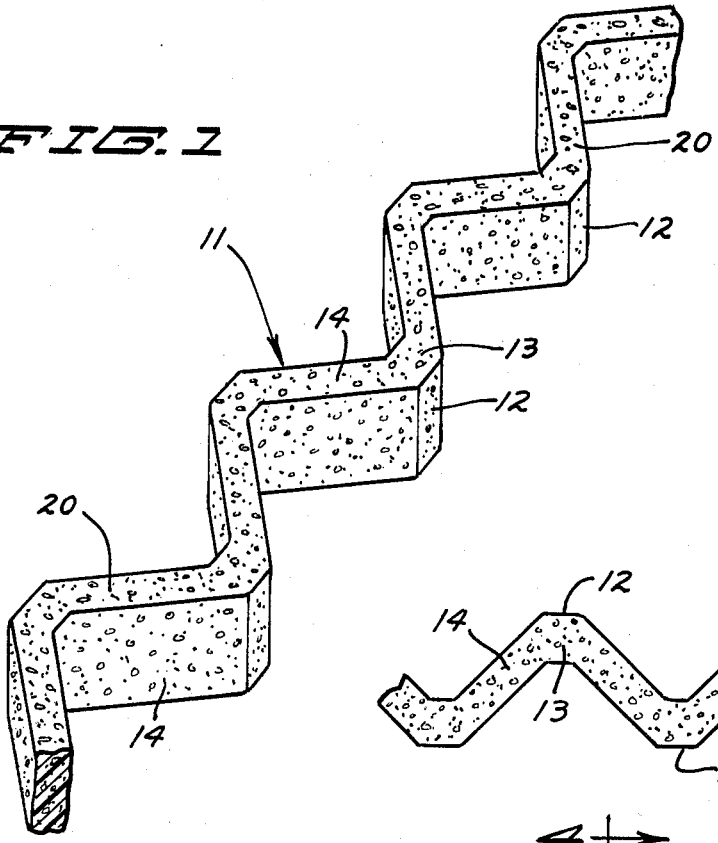
FIG. 2
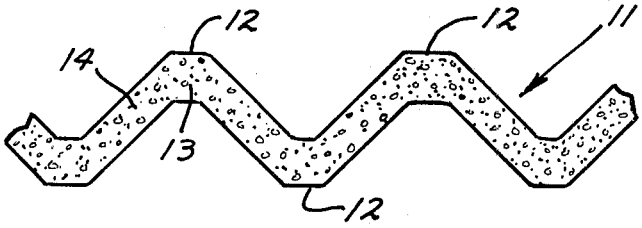
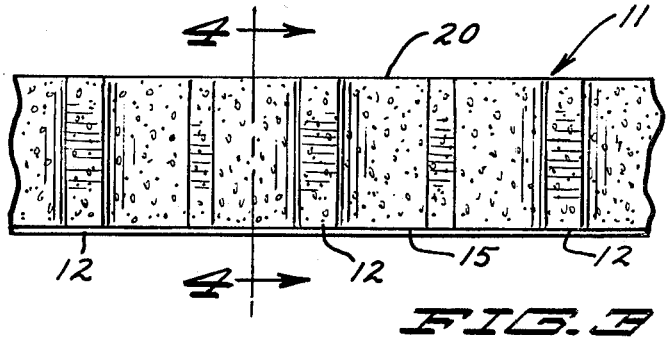
FIG. 3
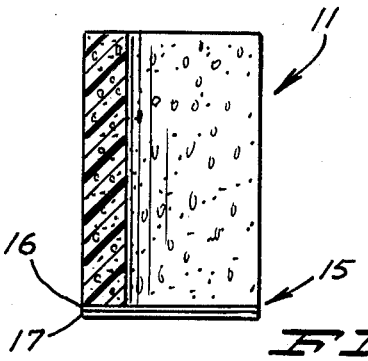
FIG. 4
FIG. 6
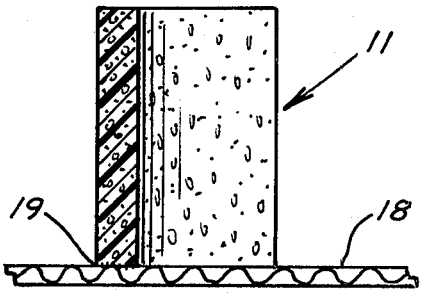
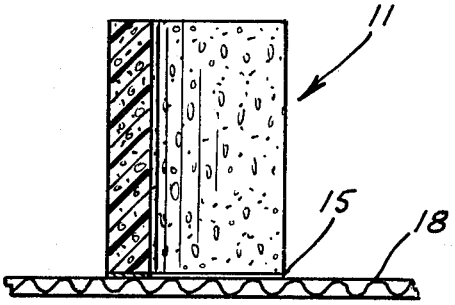
FIG. 5

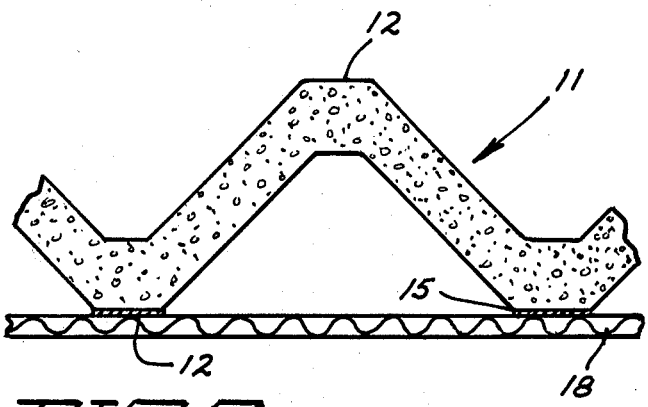
FIG. 7
FIG. 6
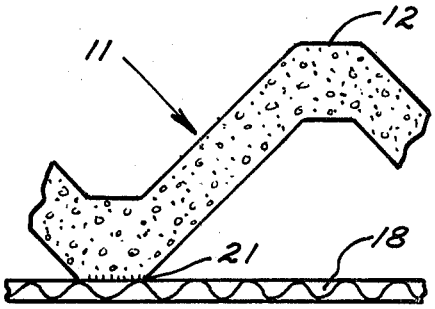
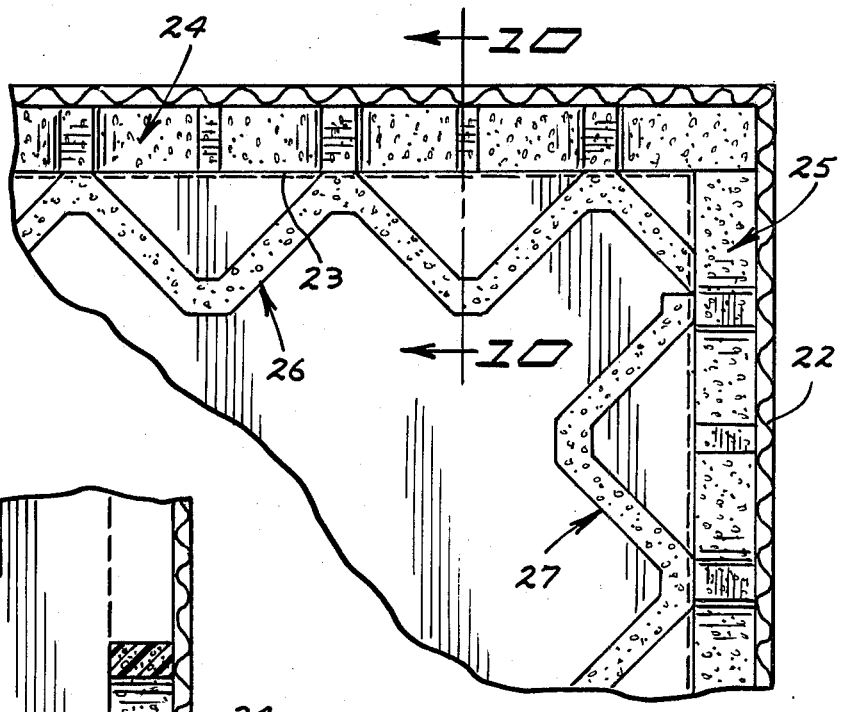
FIG. 10
FIG. 9
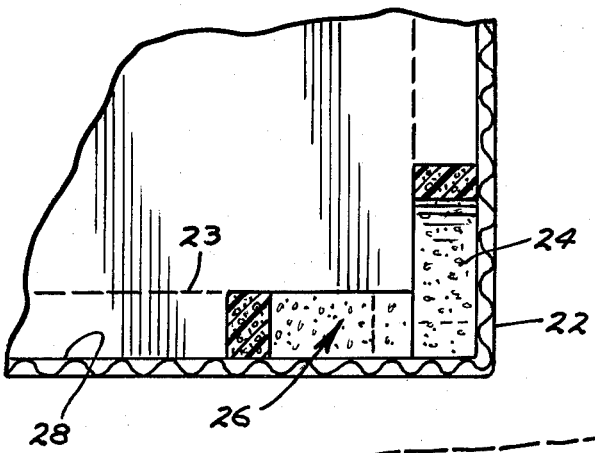
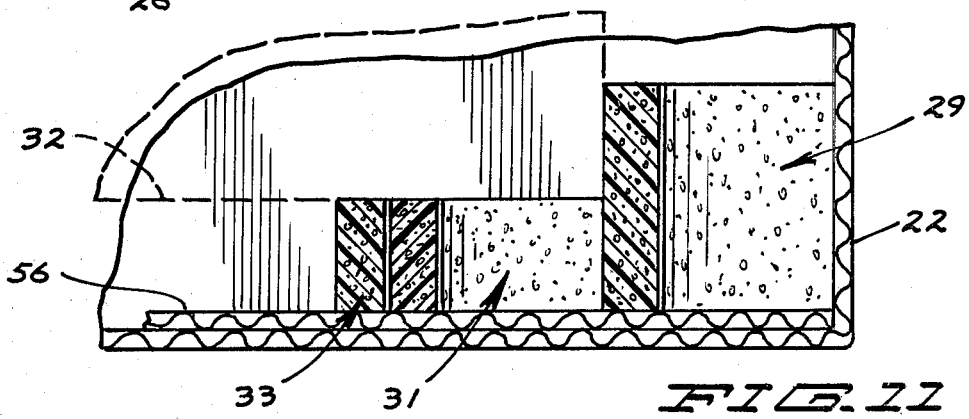
FIG. 11

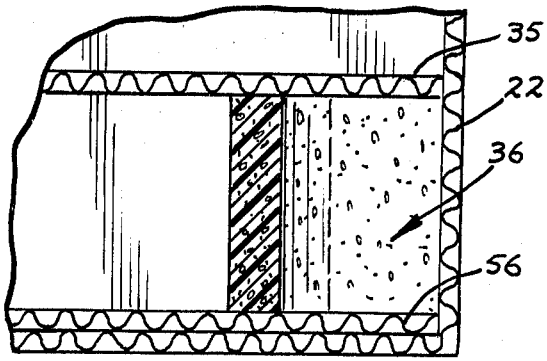
FIG. 12
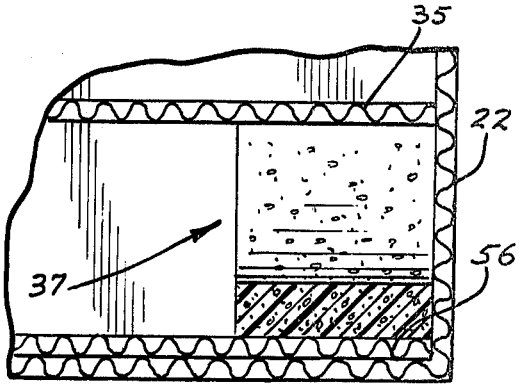
FIG. 13
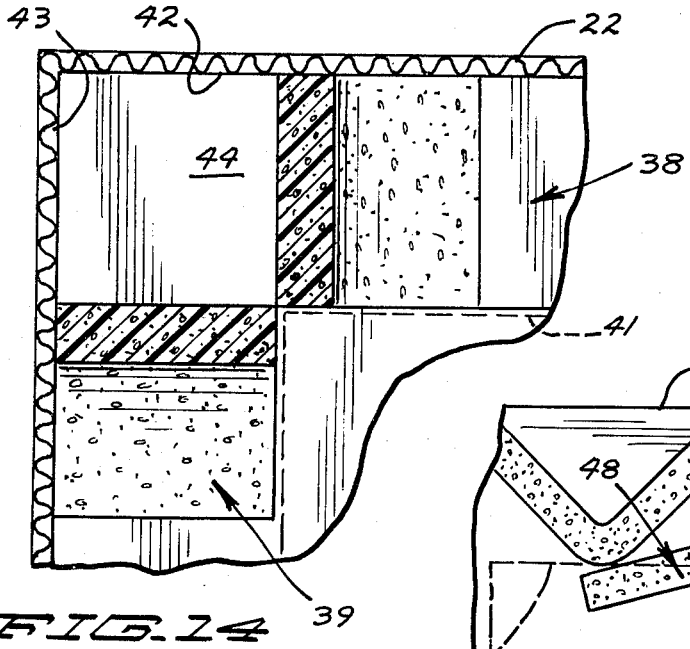
FIG. 14
FIG. 15
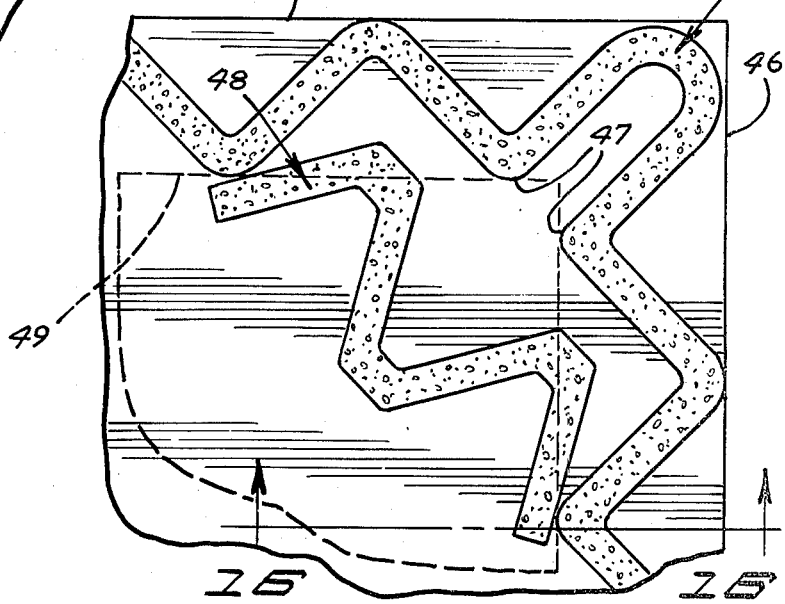
FIG. 16
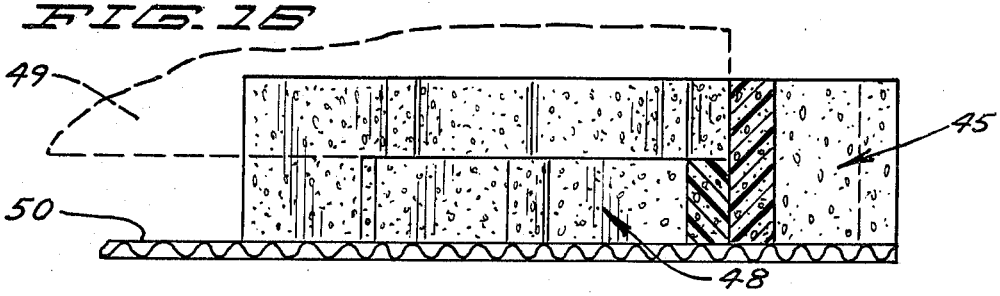

CUSHIONING FOR CONTAINER

BACKGROUND OF INVENTION

This invention relates to the packaging of objects in containers, and, more particularly, to a plastic strip used alone or in combination with other such strips to cushion loads in shipping or storage containers.

A wide variety of cushioning materials are used by the packaging industry as well as by households to make sure that fragile or breakable objects do not suffer damage during shipment. Crumpled up newspaper or strips of paper have long been used for packing around the objects in cardboard boxes prior to shipment. More sophisticated materials, such as those formed of foamed plastic, have also been used, especially for the shipment of expensive and finely tuned equipment such as stereo sets, television sets, and the like.

Although plastic spacers and cushioning pads have established their worth in specific applications, a number of areas still present packaging problems. Most significantly, existing plastic cushioning materials have either been too rigid or too resilient for a number of applications. Excessive rigidity means that a particular spacer can only be used with one shape of load to be cushioned, and cannot be bent or deformed to accommodate different shapes of loads. This in turn requires the use of a number of differently shaped spacers. Even then only a limited number of objects can be cushioned. Resilient spacers have solved the problem of different shapes of objects, but only at the expense of greatly reduced cushioning ability.

One type of resilient packaging spacer, disclosed in Knapp, U.S. Pat. No. 3,314,584, is formed in a zig-zag configuration of foamed polystyrene, and has a hinged structure to that it can be wrapped around the corner of a package. Another presently available resilient packaging spacer is disclosed in Siburn, U.S. Pat. No. 3,752,384. Other packing materials, generally of a resilient composition, are disclosed in Pezely, U.S. Pat. No. 3,334,792; Stone, U.S. Pat. No. 3,049,260; and Flaxenburg, U.S. Pat. No. 3,231,124. However, there have been no spacers or cushioning materials providing satisfactory cushioning and yet being sufficiently deformable or flexible to accommodate a wide variety of differently shaped objects.

STATEMENT OF THE INVENTION

In accordance with this invention there is provided a wave-shaped semi-rigid plastic strip having planar surfaces at the wave peaks or crests and also in the troughs, such that the strip can be positioned for cushioning either on its side or on the planar surfaces of the wave peaks. The plastic strip or a number of such plastic strips used together can be positioned within a container so as to obtain maximum cushioning for a load to be placed therein. Alternately, the strip or strips can be first attached to a pad adapted to fit within the container, the strips being secured in proper position on the pad such that they will afford maximum cushioning of the load. Preferably, an adhesive layer can be applied to the sides of the strip or to the planar surfaces of the wave peaks, or to both of such surfaces, such that the strip can be firmly attached within the container or to the pad, as desired.

It is a primary object of this invention to provide a semi-rigid cushioning strip or strips which can be used alone or in combination with other such strips and which combines high cushioning capability with sufficient flexibility to accommodate objects of widely varying shape.

It is another object of this invention to provide a semi-rigid cushioning strip or strips which can be adhesively attached to a pad adapted to fit within a container, for permanent prepositioning of the strip or strips prior to placement of the load within the container.

It is a further object of this invention to provide a semi-rigid strip which can be combined with other such strips and positioned within a container so as to obtain varying degrees of cushioning capability, for loads of different sizes and weights.

The wave shape of the plastic strip of this invention, together with the use of a semi-rigid plastic, preferably expanded polyethylene, provides the high cushioning capability of the strip and yet allows sufficient flexibility to accommodate differently shaped objects. The planar surface of the wave peaks allows side or upright positioning of the strips, with the side positioning offering more rigidity that the alternate position. The semi-rigid composition of the strips permits them to be bent around the inside corners of the containers and otherwise deformed into a variety of configurations for just the right cushioning effect. As a result, the plastic strip of this invention comprises a unique module which can be combined with others to satisfy the most troublesome packaging problem in the quickest time, and without the use of skilled workers.

DESCRIPTION OF THE DRAWINGS

FIG. 1 is a perspective view of the plastic strip of this invention;

FIG. 2 is a plan view of a portion of the plastic strip shown in FIG. 1;

FIG. 3 is a front view of the fragmentary portion shown in FIG. 2;

FIG. 5 is an end view in section of the plastic strip shown in FIG. 3, taken along line 4—4.

FIG. 5 is an end view of the plastic strip showing its attachment to a box;

FIG. 6 is similar to that of FIG. 5 but shows an alternate form of attachment;

FIG. 7 is a fragmentary front view showing positioning of the plastic strip on its planar surfaces and attachment to a box;

FIG. 8 is a fragmentary front view similar to that of FIG. 7 but showing an alternate attachment of the plastic strip to the box;

FIG. 9 is a fragmentary plan view of a container with plastic strips of this invention positioned therein;

FIG. 10 is a vertical section taken along line 10—10 of FIG. 9 showing a pair of plastic strips of this invention positioned therein;

FIG. 11 is a vertical sectional view of a container showing different sized plastic strips of this invention in position on a pad;

FIG. 12 is a vertical sectional view of a container showing a plastic strip disposed between two pads;

FIG. 13 is a vertical sectional view of a container showing alternate positioning of the plastic strip between two pads;

FIG. 14 is a fragmentary plan view taken on a horizontal plane showing the vertical alignment of two plastic strips.

FIG. 15 is a fragmentary plan view of a container showing a pair of plastic strips disposed therein on a pad, one of the strips being bent around an inside corner of the container;

FIG. 16 is a front elevational view taken along line 16—16 of FIG. 15 showing the two plastic strips attached to the pad;

DESCRIPTION OF THE PREFERRED EMBODIMENTS

Figure 17:
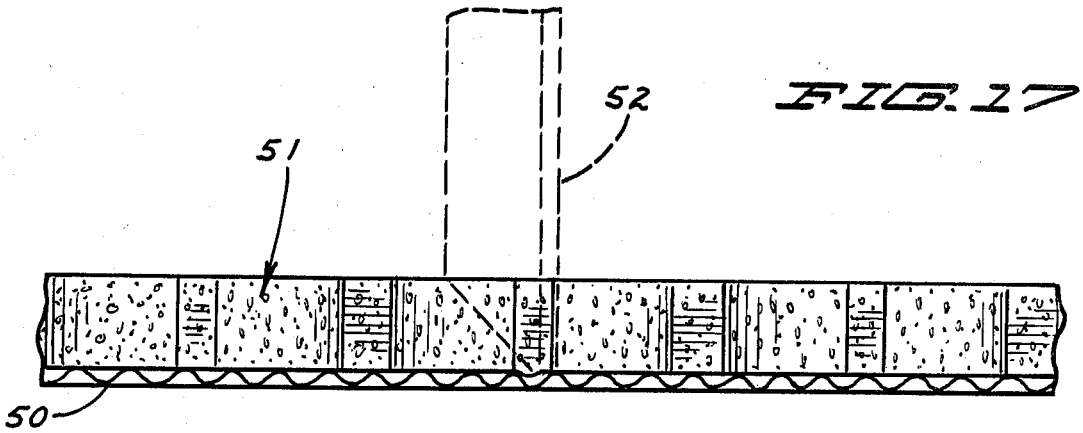
FIG. 17 is a vertical sectional view taken along line 17—17 of FIG. 18 showing positioning of a plastic strip on a bendable pad.

Referring to the drawings, FIG. 1 shows a semi-rigid plastic material and having planar surfaces 12, at the peaks or crests of the waves, and similar planar surfaces at the troughs and edge surfaces 20. Plastic strip 11 is shown "on edge;" i.e., on edge surfaces 20 of one of its lateral sides. As will be shown in succeeding figures, plastic strip 11 can be placed upright on one series of coplanar surfaces 12, to provide a second type of cushioning effect. That is, the "on edge" positioning will provide a more rigid cushioning structure whereas the upright positioning will allow for more resiliency and a softer cushioning effect.

Plastic strip 11 is preferably formed in one piece of expanded polyethelene plastic. A number of the strips may be formed by extrusion methods or by cutting from plastic stock. It is essential that the plastic used be semi-rigid, i.e., that the plastic have a substantially rigid structure that will at the same time be somewhat flexible such that the strips will spring back into shape after being deformed. It is the combination of the wave shape and the semi-rigid structure of the strips that provides the superior container cushioning of this invention.

Plastic strip 11 is also preferably formed of semi-rigid plastic material in a greater thickness at the crest portion 13 of the strip that at intermediate portions or flat panels 14 thereof, to prevent wobbling of the strip after positioning in a container. Preferably, the strip has a height, from its "on edge" position as shown in FIG. 1 of about two inches, with a crest thickness of about 9/16 of an inch and an intermediate thickness of about 7/16 of an inch. Alternately, as illustrated in FIG. 11 at 33, the strip may have a lesser height of about 1 inch. The density of the semi-rigid plastic runs from about 1.0 to 9.0 lb/ft$^3$. An especially preferred semi-rigid plastic for use in the cushioning strip of this invention is Ethafoam, a trademark of Dow Chemical Company for its polyethylene foam.

As shown in FIG. 2, the planar surfaces 12 of the wave crests are preferably aligned on each side of plastic strip 11, such that the strip may be placed in upright position on either series of planar surfaces. FIG. 2 further shows the increased thickness at the crest portion 13, as opposed to the thinner intermediate portion 14.

FIG. 3 shows the "on edge" positioning of plastic strip 11 in front elevation. The surface area of edge surface 20 supports the cushioned load in this position. As shown in the following figures, the load can be placed atop plastic strip 11 on edge surface 20 or to either side thereof within a container. Pressure sensitive adhesive strip 15 is secured to the bottom side of strip 11, as will be shown in more detail in FIG. 4.

FIG. 4 shows the plastic strip 11 "on edge" having pressure sensitive adhesive 15 on its bottom edge. Adhesive 15 is formed of a layer of pressure sensitive adhesive 16 bonded to the lower edge of plastic strip 11, such adhesive layer 16 being covered by a peel-off protective strip 17.

The plastic strips of this invention can be used alone or with one or more other plastic strips to provide superior cushioning for a variety of objects of different weights and sizes. Similarly, the plastic strips can be used with or without adhesive or glue within a container. For many applications, however, it is desirable that the strips be firmly secured within a container. For this reason adhesive or glue will be required. Because of the stiffness of the strip 11, taken together with the wave shape thereof, the adhesive attachment to a stiff panel of a container or to a stiff pad contributes materially to the stability of the upright strip. Any tendency of the strip to tip or collapse is materially reduced by the adhesive connection to a container panel. In addition, where a particular configuration of plastic strips is to be used for a specific object to be cushioned, one or more of the plastic strips can be secured to a pad of cardboard or the like, to obtain prepositioning in accordance with such configuration before the strips are positioned or placed within the container. That is, the plastic strip or strips are first glued to a pad, and the pad with the strips firmly secured thereto is then placed within the container, following which the object is positioned as desired within the conainer on the cushioning strips.

FIGS. 5 and 6 illustrate two means for securing plastic strip 11 to pad 18. In FIG. 5, plastic strip 11 is secured to the bottom of box 18 by means of adhesive 15, after the peel-off protective strip 17 as shown in FIG. 4 has been peeled off. In FIG. 6, plastic strip 11 has been welded onto box 18 using a hot melt glue at surface 19.

In FIGS. 7 and 8, plastic strip 11 is secured in its upright position to box 18 on planar surfaces 12 at the peaks of the waves. In FIG. 7, adhesive 15 is used to bond the planar surfaces 12 to the upper surface of pad 18. In FIG. 8, planar surfaces 12 are welded by a hot melt glue at juncture 21 to the upper surface of box 18.

FIG. 9 shows the use of a plurality of plastic strips 24, 25, 26, and 27 positioned both on edge and in upright position within a box 22 to provide cushioning for an article outlined by dotted line 23. Plastic strips 24, 25 are shown in upright position along the inner walls of box 22, whereas plastic strips 26, 27 are shown in "on edge" position on the bottom of box 22 and extending out from the side walls thereof.

FIG. 10 shows article 23 being supported by plastic strip 26 in its "on edge" position on the bottom 28 of box 22, the side of article 23 being cushioned by the upright positioned plastic strip 24 running along the inside wall of box 22.

FIG. 11 shows plastic strips 29 and 31 in position within box 22. Both plastic strips, 29, 31 are secured to a pad 56, the assembly of plastic strips and pad having been positioned within the box 22 prior to introduction of the article to be shipped, designated by dotted line 32.

In FIGS. 12, 13, plastic strips of this invention are positioned within a box 22 between two pads, 56, 35. In FIG. 12, plastic strip 36 is shown in its "on edge" position, whereas in FIG. 13 plastic strip 37 is shown in its upright position. The use of two pads, with the plastic strip in either its upright or more rigid "on edge" position, illustrates the great flexibility in cushioning effect made possible by use of the plastic strips of this invention.

In FIG. 14, a pair of plastic strips 38, 39 are vertically positioned within container 22 adjacent the corners of article 41 contained therein. Plastic strips 38, 39 can be secured along sides 42, 43 to the inner walls of container 22, using the hot melt glue weld or an adhesive. Alternately, plastic strips 38, 39 can be loosely positioned within container 22 around open corner area 44 either after or prior to introduction of article 41 into the container. That is, FIG. 14 illustrates the superior versatility of the cushioning strips of this invention, and the ease with which they may be positioned in any particular configuration within a container for cushioning of objects therein.

FIGS. 15, 16 illustrate yet another configuration of the plastic strips of this invention within a container 22. Here plastic strip 45 has been bent around corner 46 and otherwise has crests 47 extending into the interior of container 22. A second plastic strip 48 is positioned as shown to provide further bottom cushioning for the article represented by dotted line 49. As shown in FIG. 16, plastic strip 45 is substantially higher than plastic strip 48, to thereby provide side cushioning for article 49. Also, both plastic stripes 45 and 48 are secured to pad 50, the entire assembly being positioned within container 22 prior to introduction therein of article 49.

Figure 18:
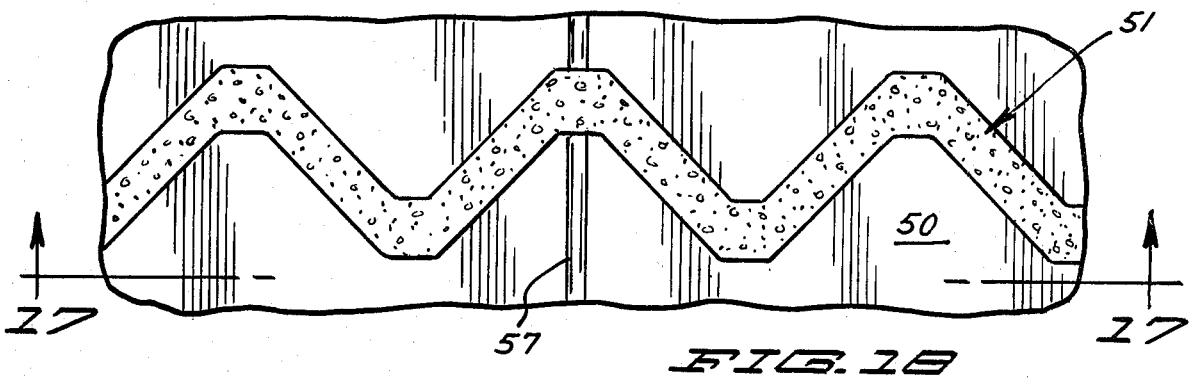
FIG. 18 is a fragmentary plan view of the strip and pad of FIG. 17.

FIGS. 17, 18 show the positioning of a strip 51 in its "on edge" position and secured to a pad 50 which can be bent along seam 57 to the upright position shown by dotted lines 52. Pad 50 can then be inserted into a container in the bent position, with strip 51 attached.

Figure 19:
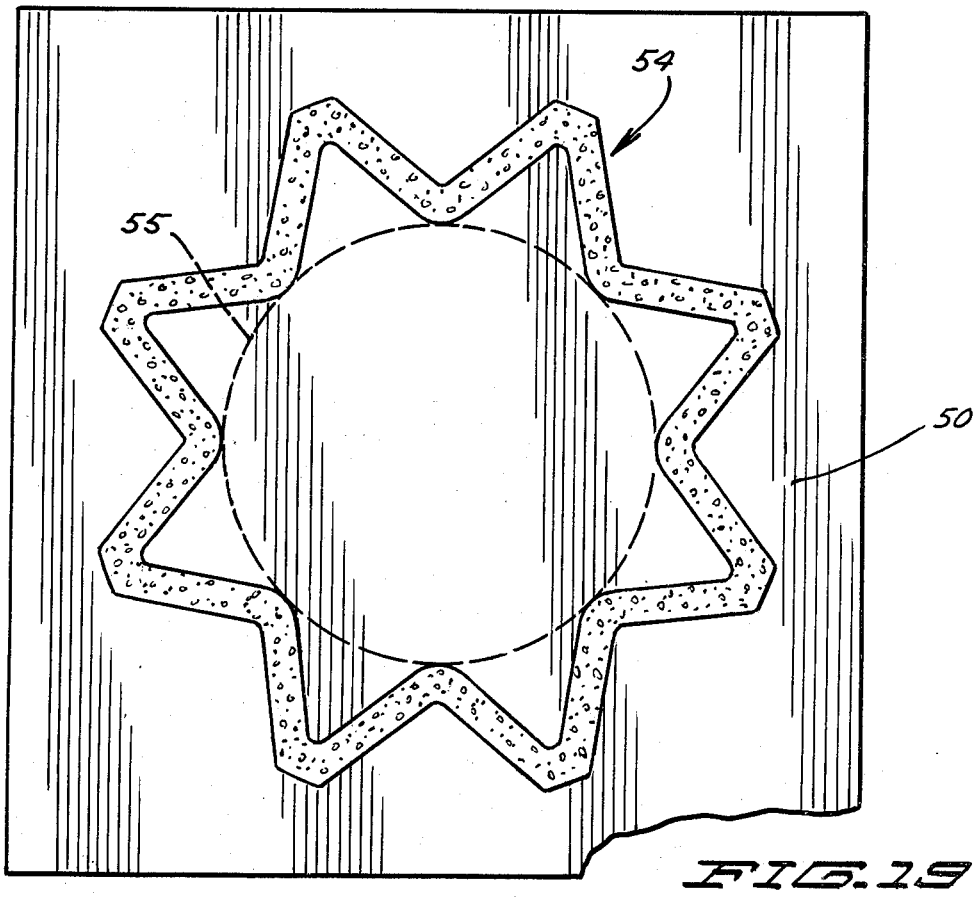
FIG. 19 is a plan view of a container showing plastic strips of this invention arranged in a star pattern.

In FIG. 19, plastic strip 54 has been bent into a star configuration and secured to pad 50. A round shaped object, such as a bottle, represented by line 55, can be positioned within the star shaped plastic strip 54 to provide cushioning for such article.

It is seen that the plastic strip of this article can be used either by itself or with a number of other such strips for arrangement in a container, either loosely or secured to a cardboard pad or the like, for providing superior cushioning for all purposes of an article to be shipped, no matter what the size or shape of the article.

It is claimed:

1. A semi-rigid plastic cushioning strip having a wave shape and being adapted to fit singly or with other such strips within containers to cushion loads contained therein, the strip being formed integrally and in one piece of semi-rigid resilient foamed plastic, the wave shape of the strip defining crests and troughs extending across the entire width of the strip, and the strip also having wave shaped side edges to respectively engage the load and container, the strip including a multiplicity of substantially flat panels the width of which is the same as the width of the strip, the width of the strip significantly exceeding the thickness of the panels, and the strip having planar surfaces extending entirely across the width of the strip at all of the wave crests and troughs, such that the strip can be positioned on either side edge.

2. The plastic strip of claim 1 wherein the adhesive means includes a strip of pressure sensitive adhesive material.

3. The plastic strip of claim 1 and adhesive means on one of said side edges for attachment to a panel in the container to rigidify the strip against collapse and tipping and to locate the strip in the container.

4. The plastic strip of claim 3 wherein the adhesive means is formed by application of hot melt glue to one of the side edges of the strip.

5. The plastic strip of claim 1 wherein the strip is formed in one piece of expanded polyethylene.

6. The plastic strip of claim 3 additionally comprising a pad adhesively attached to said one side edge of the strip.

7. The plastic strip of claim 6 wherein the pad is formed of corrugated cardboard.

8. The plastic strip of claim 1 wherein the strip has a width of about one to two inches.

9. The plastic cushioning strip of claim 1 wherein the strip is substantially linear with the planar surfaces on adjacent wave crests lying substantially in a common plane.

10. The plastic cushioning strip of claim 1 wherein the strip is flexible to accommodate bending the strip at one of the troughs of the wave shape whereby the planar surfaces on adjacent crests lie transversely of each other.

11. A semi-rigid plastic cushioning strip for cushioning loads within box-like containers, comprising an elongate cushioning strip formed of resilient foamed plastic and being stiff and semi-rigid to support such a load and maintain the load in spaced relation with the panels of the container, the strip being formed integrally and in a one piece construction and having a wave shape defining crests and troughs extending across the entire width of the strip, the wave shaped strip having wave shaped side edges to respectively engage one of the container panels and the load, the strip including a multiplicity of substantially flat panels intermediate adjacent crests and troughs and extending across the entire width of the strip, the width of the strip significantly exceeding the thickness of the panels and of the crest and trough portions between the panels, and the strip having surfaced portions at said crests and troughs which lie obliquely of the intermediate panels, and one of the wave shaped side edges of the strip being provided with adhesive means for attachment to a panel in such a container.

* * * * *